US006217055B1

(12) United States Patent
Silva

(10) Patent No.: US 6,217,055 B1
(45) Date of Patent: Apr. 17, 2001

(54) SKI EQUIPPED WITH AN INTERFACE DEVICE PROVIDED FOR SUPPORTING BOOT RETAINING ELEMENTS

(75) Inventor: Gilles Silva, Le Montcel (FR)

(73) Assignee: Salomon S.A., Metz-Tessy (FR)

( * ) Notice: Subject to any disclaimer, the term of this patent is extended or adjusted under 35 U.S.C. 154(b) by 0 days.

(21) Appl. No.: 09/449,523

(22) Filed: Nov. 29, 1999

(30) Foreign Application Priority Data

Nov. 27, 1998 (FR) ..... 98 15177

(51) Int. Cl.[7] ..... A63C 5/00
(52) U.S. Cl. ..... 280/607; 280/602; 280/618
(58) Field of Search ..... 280/602, 607, 280/609, 617, 618, 626, 809, 636, 615

(56) References Cited

U.S. PATENT DOCUMENTS

| | | | | |
|---|---|---|---|---|
| 3,797,839 | * | 3/1974 | Smolka et al. | 280/602 |
| 4,067,593 | * | 1/1978 | Earl | 280/607 X |
| 4,714,267 | * | 12/1987 | Abondance et al. | 280/615 |
| 4,738,465 | * | 4/1988 | Prinz | 280/607 |
| 5,431,427 | | 7/1995 | Pieber et al. | 280/607 |
| 5,474,321 | * | 12/1995 | Pritz | 280/607 |
| 5,895,068 | * | 4/1999 | Doyle | 280/618 |
| 5,984,344 | * | 11/1999 | Harsanyi et al. | 280/602 |

FOREIGN PATENT DOCUMENTS

| | | | |
|---|---|---|---|
| 625709 | * | 10/1981 | (CH) . |
| 2134810 | * | 4/1972 | (DE) . |
| 3541682 | * | 5/1987 | (DE) . |
| 4112299 | * | 12/1991 | (DE) . |
| 4321239 | | 1/1994 | (DE) . |
| 19542055 | | 5/1997 | (DE) . |
| 744195 | * | 11/1996 | (EP) . |
| 0835675 | | 4/1998 | (EP) . |
| 835675 | * | 4/1998 | (EP) . |
| WO 98/48907 | | 11/1998 | (WO) . |

* cited by examiner

*Primary Examiner*—Paul N. Dickson
*Assistant Examiner*—Bryan Fischmann
(74) *Attorney, Agent, or Firm*—Greenblum & Bernstein, P.L.C.

(57) ABSTRACT

A ski in the form of an elongate beam extending in a longitudinal direction and having a sole, an upper surface and lateral edges. In a central part, the ski is overhung by a raised rigid platform, the platform having, in an upper part, mounting zones provided for the boot retaining elements. The platform of the ski has a front plate and a rear plate which have, in their lower part, lateral side edges with support surfaces. Further, beneath the level of the upper surface of the ski, the ski has bottom surfaces located opposite the support surfaces, and the support surfaces and the bottom surfaces are predetermined such that when the ski is at rest, the platform bears on the ski in the area of the median part of the platform. Further, the distance between each support surface and its bottom surface progressively increases in the direction of the ends of the plates, such that the surfaces progressively enter into contact with one another as the ski bends.

23 Claims, 4 Drawing Sheets

SKI EQUIPPED WITH AN INTERFACE DEVICE PROVIDED FOR SUPPORTING BOOT RETAINING ELEMENTS

BACKGROUND OF THE INVENTION

1. Field of the Invention

The present invention relates to a ski equipped with an interface device provided for supporting boot retaining elements.

2. Description of Background and Relevant Information

As known, a ski is formed as an elongate beam which supports, in its central part, the boot and the elements for retaining the boot on the ski.

During gliding, the ski is deformed depending on the terrain and the skier's supports. The ski bends along a curvature which depends on the rigidity of the ski, particularly in turns.

The parameters affecting the ski deformation are its side cuts, the internal ski structure, as well as its curve thickness, the installation of retaining elements and, if necessary, the interface device which is inserted between the retaining elements and the ski.

The retaining elements and the insert interfaces stiffen the ski zones that support them. As a result, they create hindrances in the normal bending of the ski which are felt through abrupt curvature variations in the deformation curve of the ski and through curvature breaks in the distribution curve of ski pressure on the snow. These pressures can adversely impact the behavior of the ski depending on their location and the phase of the turn in question.

This is felt particularly with current skis having a wasp-waisted side cut that is very pronounced. As a matter of fact, in turns, such a ski bends, the running edge on the inside of the turn grips the snow and digs a sort of furrow which determines the ski trajectory. It is therefore advantageous to control the curvature of the ski and the running edge in the different phases of a turn.

SUMMARY OF THE INVENTION

One object of the invention is to improve the control of the behavior of a ski on snow, mainly in the phases of a turn.

Another object of the invention is to propose a device which is simple to build.

Other objects and advantages of the invention will appear throughout the following description.

The ski forms an elongate beam along a longitudinal direction and has a sole, an upper surface and lateral sides. It is overhung, in its central part, by a raised rigid platform, the platform having, in its upper part, mounting zones provided for the boot retaining elements. The platform of the ski has a front plate and a rear plate which have, at their lower part, lateral side edges with support surfaces. Beneath the area of the upper surface of the ski, the ski has bottom surfaces located opposite the support surfaces. The support surfaces and the bottom surfaces are predetermined such that when the ski is at rest, the platform bears on the ski in the area of the median part of the platform, and the distance between each support surface and its bottom surface progressively increases in the direction of the ends of the plates, such that the surfaces progressively come into contact with one another as the ski bends.

BRIEF DESCRIPTION OF DRAWINGS

The invention will be better understood with reference to the following description and attached drawings which are an integral part thereof, wherein.

DETAILED DESCRIPTION OF THE INVENTION

Figure 1:
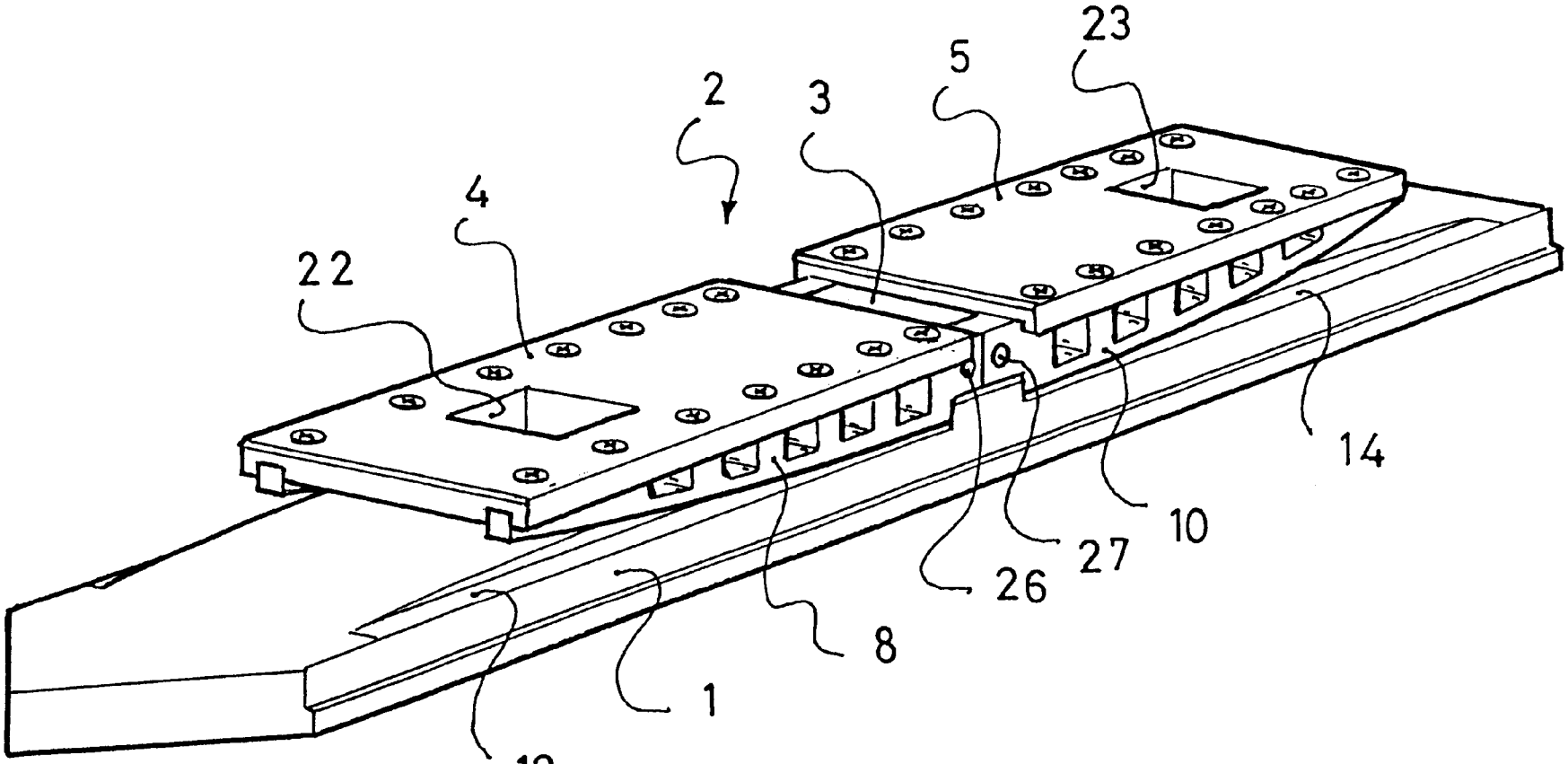
FIG. 1 is a perspective view of the ski equipped with the interface device according to a first embodiment of the invention.

FIG. 1 represents the central part of a ski 1 equipped with an interface device according to a first embodiment of the invention. As is known, the ski 1 is an elongate beam with a shovel at the front and a tail at the rear. Also is as known, the ski has a lower surface or sole bordered by two lateral running edges, an upper surface, and two lateral sides.

The interface device has a platform 2 that is raised with respect to the ski.

Figure 2:
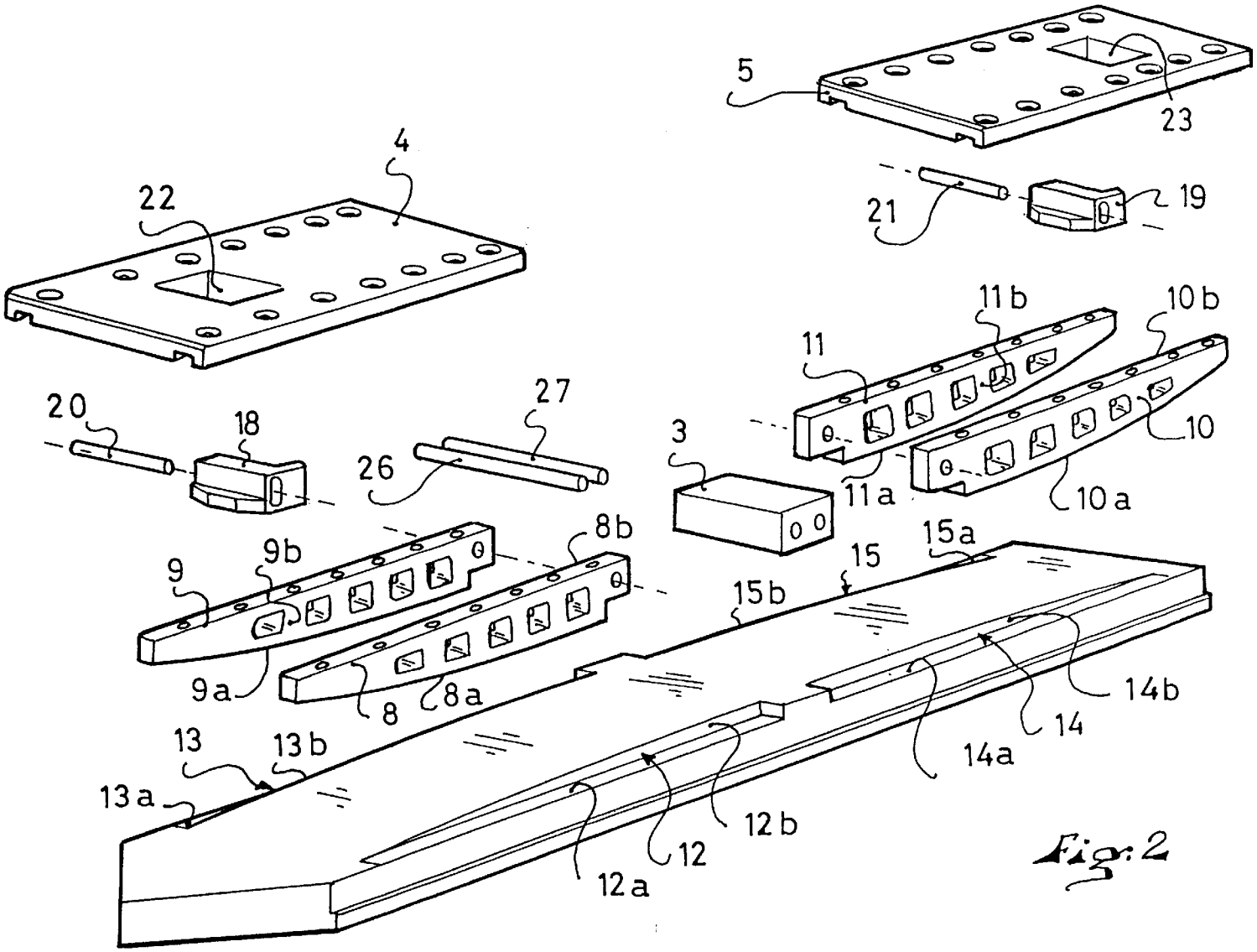
FIG. 2 is an exploded perspective view of the assembly of FIG. 1.

According to the embodiment shown in FIG. 2, the platform has, in its median part, a median block 3 which is provided to be affixed to the ski. The block extends along a transverse direction with respect to the ski. It is connected to the ski by any appropriate mechanism, for example, by screws. This is not restrictive, and the block could be glued or welded to the ski, or it could be integrated into the ski structure.

Furthermore, the platform has a front plate 4 and a rear plate 5. Each of the plates is provided to receive front and rear retaining elements 30, 31. To this end, the plates have, on their upper surface, mounting surfaces for the front and rear retaining elements.

The two plates extend substantially in each other's extension. They are connected to the block 3 by mechanism which will be described later.

The plates 4 and 5 have, in their lower part, lateral side edges, 8 and 9 for the plate 4, 10 and 11 for the plate 5. The side edges 8, 9, 10, 11 have lower support surfaces 8*a*, 9*a*, 10*a*, 11*a*.

The plates rest on the ski by way of these side edges, such that the two upper surfaces of the plates which are substantially in each other's extension form a platform that is raised with respect to the upper surface of the ski when the ski is at rest.

In the embodiment shown, the side edges are attached side edges. This is not restrictive, and the side edges could form a one piece element with the plate to which they are attached.

The ski has cutouts, respectively 12, 13, 14, 15, opposite the side edges 8, 9, 10, 11. The cutouts are located beneath the area of the upper surface of the ski. Each of the cutouts 12, 13, 14, 15 has a bottom surface 12*a*, 13*a*, 14*a*, 15*a* and a lateral surface 12*b*, 13*b*, 14*b*, 15*b*.

Thus, the side edges rest, by way of their support surfaces 8*a*, 9*a*, 10*a*, 11*a*, on the bottom surfaces 12*a*, 13*a*, 14*a*, 15*a* of the ski. Preferably, the side edges have, towards the inside of the ski, lateral surfaces 8*b*, 9*b*, 10*b*, 11*b* by which they are guided along the lateral surfaces 12*b*, 13*b*, 14*b*, 15*b* of the cutouts.

According to the invention, the support surfaces 8*a*, 9*a*, 10*a*, 11*a* and the bottom surfaces 12*a*, 13*a*, 14*a*, 15*a* have complementary curved shapes. These shapes are predetermined such that when the ski is at rest on a flat surface, the side edges rest on the cutouts in their respective zone located in the median part of the platform, near the block 3. In this zone, the support and bottom surfaces are tangential. From this zone, the distance between a contact surface and a bottom surface progressively increases such that when the ski bends, either the two surfaces roll one along the other, or the contact zone between the two surfaces is displaced by being distanced from the block. In the first case, the skier's support on the skis results in a pressure that is centered in the median zone of the ski and which is dispersed on each side as the ski bends. In the second case, the pressure curve has two peaks that progressively move away from one another.

In both cases, when the ski bends, the support and bottom surfaces force a deformation on the ski along a theoretical curve which is advantageous to the behavior of the ski on snow.

The curvature of the support and bottom surfaces takes into account the bending rigidity of the ski. The surfaces are tapered portions, for example.

In tests, good results were obtained with plates and lateral sides of 290 to 300 millimeters in length. Rolled out along a planar counterform, the support surface of a side is tangential to the counterform in the block zone, and rises up to 12 millimeters in the area of its end. Between these two points, the curvature of the support surface conforms to the equation of a tapered curve with an expandable radius.

These figures are not restrictive and the invention extends to other figures.

The support and bottom surfaces can all be curved, as is shown in the figures. In an alternative, a part of the surfaces, for example, the bottom surfaces, can be straight, and the other part can be curved. The opposite is also contemplated within the scope of the invention.

The support and bottom surfaces located in the rear and the front of the block do not necessarily have the same general shape and the same curvature, i.e., the curvature can be more pronounced on one side than on the other.

Additionally, the shapes and curvatures can be different on the inside and on the outside of the ski to create a slight lateral deformation of the ski.

The ski cutouts and plate sides can have, as seen from the top, curved shapes, for example, curved shapes that follow the side cuts of the ski, or which have a more or less pronounced curvature. In this regard, the thickness of the sides can also vary, and the sides, for example, can be thicker towards the median block 3 and finer towards the ends of the plates.

The cutouts can also be located more towards the middle of the ski, i.e., its longitudinal plane of symmetry. Thus, it is possible to have a central groove or two grooves spread over the width of the ski. According to another alternative, the cutouts located on the same side of the ski could be connected in a continuous manner.

The fact that the side edges of the plates progressively penetrate into the cutouts dug into the ski enables the lateral side edges to be guided laterally along the lateral surfaces 12*b*, 13*b*, 14*b*, 15*b* of the cutouts. Furthermore, this keeps the upper surface of the plates from being raised in an exaggerated manner with respect to the ski sole.

Preferably, towards each of the ends of the platform, the device has an abutment 18, 19, which is provided to be affixed to the ski. In the embodiment shown, the abutments have a vertical slot through which is crossed by a pin, respectively 20, 21, mounted in the lower part of the plates 4 and 5. The plates have recesses 22, 23 in the area of the abutments.

The slots of the abutments are provided to restrict the displacement path of the pins as they become spaced with respect to the ski beyond the position that they occupy when the ski is at rest on a flat surface. Other mechanisms could also be used.

According to a preferred embodiment, the plates are connected to the median block by journals about a transverse axis. With reference to FIG. 2, the lateral side edges 8, 9, 10, 11 of the plates are extended up to the area of the median block 3 where transverse axes 26, 27 connect them to the blocks. Any other appropriate mechanisms can be used to achieve these journals, for example, screws screwed into the block.

Advantageously, the plates can be connected by a hook or a non-extensible link which would be taut when the two plates are flat in each other's extension, this in order to ease the forces that are exerted on the block in this position. However, this link does not offer resistance to the plates when they come together, which occurs when they pivot about their journal at the block when the ski bends. The plates and the block can also be obtained in a rigid one piece assembly.

Figure 3:
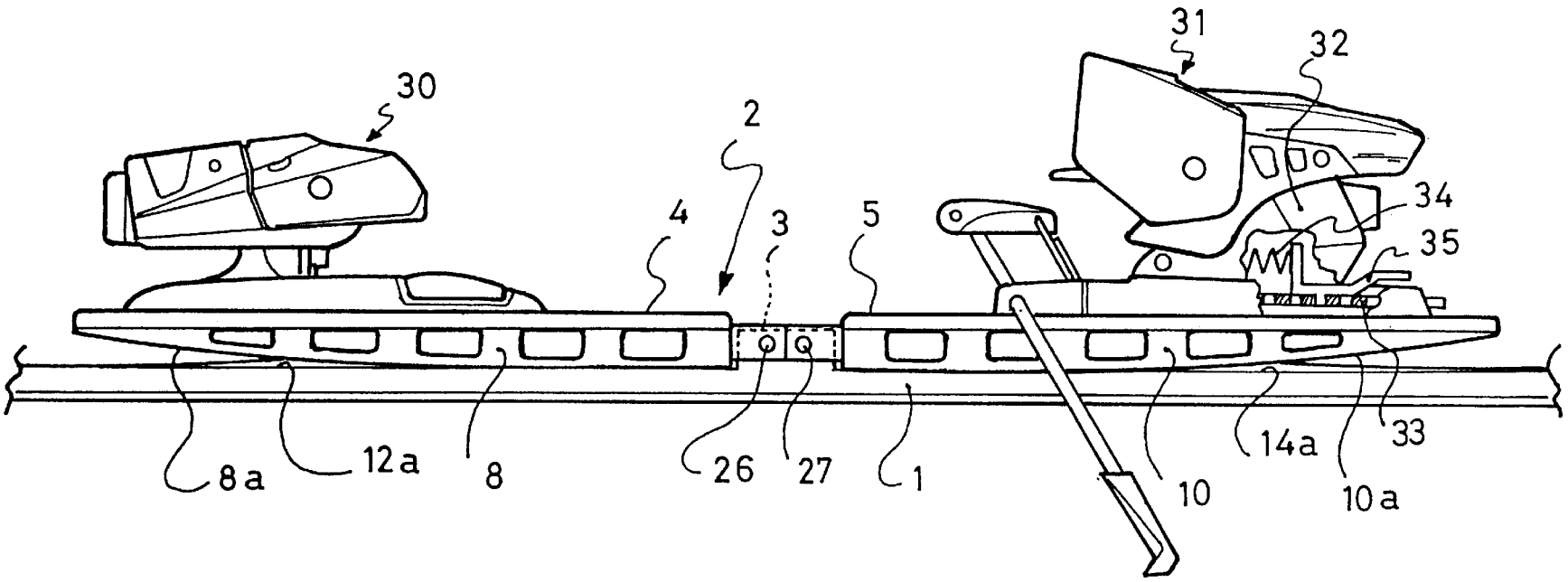
FIG. 3 is a side view of the assembly of FIG. 1 with boot retaining elements.

The functioning method of this device will be better understood with reference to FIG. 3.

The central part of the ski is shown here with the interface device. The plates 4 and 5 are overhung by two front 30 and rear 31 retaining elements. These elements are of a known type. The body 32 of the rear retaining element 31 is slidingly mounted along a slide 33. In the presence of a boot, the rear element is pushed toward the front by a spring 34, and a device, such as a latch 35, anchored on the slide, enables adjusting the longitudinal position of the body of the rear element and the intensity of the thrust of the recoil spring.

When the boot is engaged in the retaining elements, the body is biased towards the rear, and the spring 34 is compressed. The reaction to this compression of the spring is recovered locally by the plates, and it is returned towards the median block 3.

When the ski bends, the support surfaces and the bottom surfaces cooperate together. The bending also has the effect of biasing the plates into rotation about their respective journal axis. Such a rotation produces an additional recoil of the body of the rear retaining element as well as an additional compression of the spring 34. Here again, the reaction to the compression of the spring is returned towards the median block 3.

Depending on the natural rigidity of the ski and the initial thrust of the recoil spring, a balance is achieved between the two rolling effects of the support and bottom surfaces, and the rotation of the plates around the axes 26 and 27.

When the ski is flat, the supports are realigned in the central part, and the ski is freer to bend.

At the beginning of a turn, the ski that is not stressed is freer to bend, and the execution of the turn is facilitated.

In the steering phase of the turn, the ski is bent along a predetermined curvature, and the supports are displaced towards the ends, thus stabilizing the ski in its trajectory. The deformation curve of the ski is progressive, and the contact line of the ski on the snow is more uniform.

At the end of the turn, the ski progressively relaxes, giving it a rebound effect.

Figure 4:
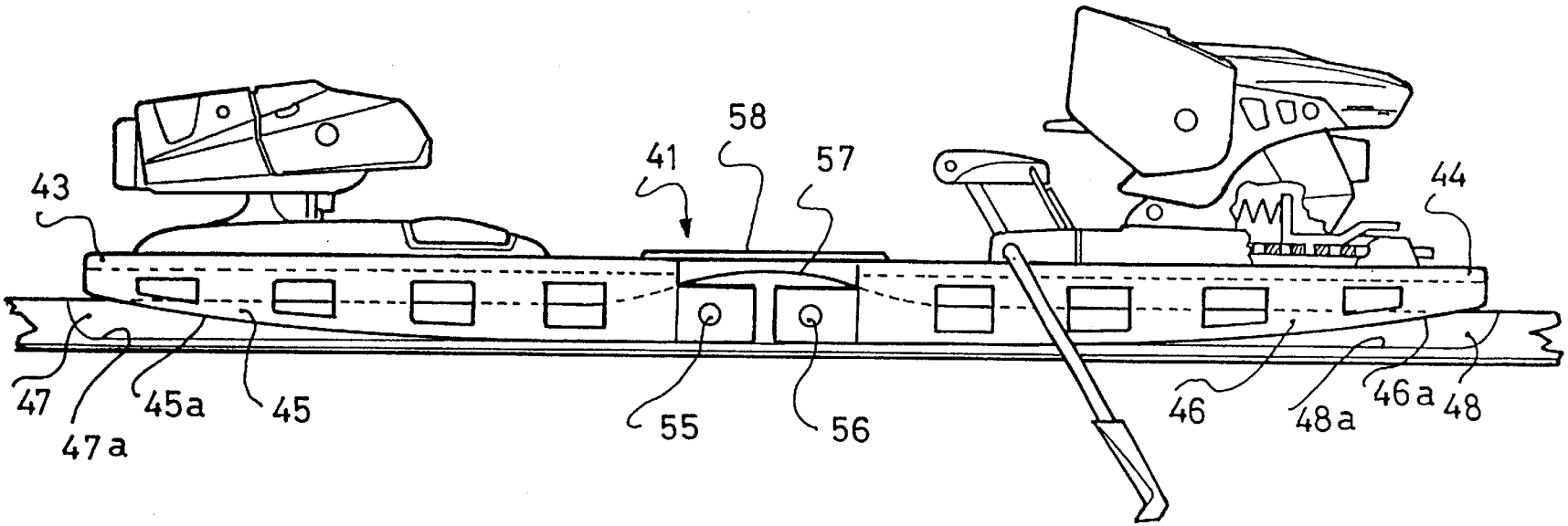
FIG. 4 relates to an alternative embodiment.

FIG. 4 relates to an alternative embodiment. According to this variation, the platform 41 has two front 43 and rear 44 plates that support the retaining elements. The plates are bordered by lateral side edges which descend along the sides of the ski. Only the sides 45, 46 are visible in the figure.

The ski has cutouts 47, 48 where the side edges are housed. Preferably, as shown, the cutouts extend downwardly almost to the level of the running edges. In other words, their bottom surface 47*a*, 48*a* is right above the running edges.

As in the preceding case, the support surfaces 45*a*, 46*a* of the side edges and the bottom surfaces 47*a* and 48*a* of the cutouts have complementary shapes which force the ski to bend in this zone along a normal curvature. These curves are, for example, tapered with an expandable radius on one side and a straight surface on the other.

The plates are connected by a transverse axis 55, 56, not to a block but to the ski itself. For this, the axes 55, 56 are located in the lower part of the side edges. Additionally, as a preference, in the area of the axes, the ski has a boss 57 which increases its thickness locally.

Inserts or any other mechanisms traversing the ski can be provided in the ski. Other connecting mechanism than the axes can also be used. For example, simple screws screwed into the ski core could be used which define the journal axes of the plates.

As in the preceding case, the side edges of the plates are preferably guided laterally against the lateral surfaces of the cutouts.

The two plates can also be provided to be connected together by a non-extensible link 58 which resists their pivoting about the axes 55 and 56. The link 58 is non-extensible but does not offer a resistance to the plates when they come together. For example, this could be a link of the hook type, or a strip of flexible material.

As in the preceding case, retaining abutments restricting the upward displacement of the plates with respect to the ski can be provided. These abutments are not represented in FIG. 4.

In an alternative embodiment, the platform could also be obtained in a one piece assembly.

The present description is given only by way of example, and other embodiments of the invention could be used without leaving the scope of the invention.

Additionally, the journals of the plates to the block could be achieved by other mechanism, for example, by an elastic deformation of a plate which would connect the two plates continuously.

Moreover, layers or blocks of elastically deformable material could be placed, for example, between the plates and the skis, between the support and bottom surfaces, in the area of the vertical retaining abutments, in order to filter the shocks and vibrations of the ski.

The instant application is based upon French Patent Application No. 98 15177, filed Nov. 27, 1998, the disclosure of which is hereby incorporated by reference thereto in its entirety, and the priority of which is hereby claimed under 35 USC 119.

What is claimed is:

1. A ski assembly comprising:

an elongated beam extending in a longitudinal direction, the beam including a sole, an upper surface and lateral sides, each lateral side including a cutout comprising a bottom surface located below the upper surface and a lateral surface;

a raised rigid platform disposed adjacent the upper surface in an area of a longitudinal central part of the beam, the platform including an upper part adapted to retain boot retaining elements and defining mounting zones, the platform comprising:

a front plate comprising a lower part and lateral side edges, each of the lateral side edges comprising a support surface and a lateral side surface wherein the lateral side edges are adapted to moveably engage the cutouts; and a rear plate comprising a lower part and lateral side edges, each of the lateral side edges comprising a support surface and a lateral side surface wherein the lateral side edges are adapted to moveably engage the cutouts;

the support surfaces of one of the front and rear plates being configured to engage the bottom surfaces of the cutouts;

the lateral side surfaces of one of the front and rear plates being configured to engage the lateral surfaces of the cutouts;

wherein each support surface of one of the front and rear plates is progressively distanced from each corresponding bottom surface such that the support surfaces and the cooperating bottom surfaces progressively enter into contact with one another when the beam bends.

2. The ski assembly of claim 1, wherein the cutouts comprise front cutouts which cooperate with the lateral side edges of the front platform and rear cutouts which cooperate with the lateral side edges of the rear platform.

3. The ski assembly of claim 1, wherein the support surfaces of the front and rear plates comprise a curved shape.

4. The ski assembly of claim 3, wherein the bottom surfaces comprise a curved shape.

5. The ski assembly of claim 1, wherein the bottom surfaces comprise a curved shape.

6. The ski assembly of claim 1, wherein the bottom surfaces of the cutouts comprise straight non-curved surfaces extending in the longitudinal direction.

7. The ski assembly of claim 1, further comprising at least one abutment which is fixed to the beam, the abutment limiting the movement of one of the front and rear plates.

8. The ski assembly of claim 7, wherein the abutment is disposed between the beam and one of the front and rear plates so as to limit the movement of the front or rear plate towards the beam.

9. The ski assembly of claim 7, wherein the abutment is disposed between the beam and one of the front and rear plates so as to limit the movement of the front or rear plate away from the beam.

10. The ski assembly of claim 1, further comprising a median block fixed to the beam, wherein each of the front and rear plates are moveably connected to the median block.

11. The ski assembly of claim 1, further comprising a median block fixed to the beam, wherein each of the front and rear plates are pivotally connected to the median block.

12. The ski assembly of claim 11, each of the front and rear plates are pivotally connected to the median block via a pin.

13. The ski assembly of claim 11, further comprising a front boot retaining element disposed on the front plate and a rear boot retaining element disposed on the rear plate.

14. A ski assembly comprising:

an elongated beam extending in a longitudinal direction, the beam including a sole, an upper surface, lateral sides, at least one front cutout, and at least one rear cutout, wherein each of front and rear cutouts comprises a bottom surface located below the upper surface and at least one lateral surface;

a front platform plate moveably connected to the beam and comprising an upper surface which is adapted to retain a boot retaining element and a front elongated projection, the front elongated projection comprising a support surface and at least one lateral side surface, wherein the front elongated projection is adapted to moveably engage the at least one front cutout; and a rear platform plate moveably connected to the beam and comprising an upper surface which is adapted to retain a boot retaining element and a rear elongated projection, the rear elongated projection comprising a support surface and at least one lateral side surface, wherein the rear elongated projection is adapted to moveably engage the at least one rear cutout;

the support surface of each of the front and rear plates being configured to engage the bottom surfaces of the front and rear cutouts;

the lateral side surfaces of each of the front and rear plates being configured to engage the lateral surfaces of the front and rear cutouts;

wherein each support surface and each corresponding bottom surface progressively enter into contact with one another when the beam bends.

15. A ski assembly comprising:

an elongated beam extending in a longitudinal direction, the beam including a sole, an upper surface, lateral sides, and at least one recessed area comprising a bottom surface located below the upper surface and at least one lateral surface;

a front platform plate moveably connected to the beam and comprising an upper surface which is adapted to retain a boot retaining element;

a rear platform plate moveably connected to the beam and comprising an upper surface which is adapted to retain a boot retaining element;

at least one of the front and rear platform plates further comprising an elongated projection comprising a support surface and at least one lateral side surface, wherein the elongated projection is adapted to moveably engage the at least one recessed area;

the support surface being configured to engage the bottom surface of the at least one recessed area;

the lateral side surface being configured to engage the lateral surface of the at least one recessed area;

wherein the support surface and the corresponding bottom surface progressively enter into contact with one another when the beam bends.

16. The ski assembly of claim 15, wherein one of the support surface and the bottom surface comprises a curved shape.

17. The ski assembly of claim 15, wherein the bottom surface of the at least one recessed area comprises a straight non-curved surface which extends in the longitudinal direction.

18. The ski assembly of claim 15, further comprising at least one abutment which is fixed to the beam, the abutment limiting the movement of one of the front and rear plates.

19. The ski assembly of claim 15, further comprising a median block fixed to the beam, wherein each of the front and rear plates are pivotally connected to the median block.

20. The ski assembly of claim 15, further comprising a front boot retaining element disposed on the front plate and a rear boot retaining element disposed on the rear plate.

21. A ski assembly comprising:

an elongated beam extending in a longitudinal direction, the beam including a sole, an upper surface and lateral sides, each lateral side including a cutout comprising a bottom surface located below the upper surface and a lateral surface;

a raised rigid platform disposed adjacent the upper surface in an area of a longitudinal central part of the beam, the platform including an upper part adapted to retain boot retaining elements and defining mounting zones, the platform comprising:

a front plate comprising a lower part and lateral side edges, each of the lateral side edges comprising a curved support surface and a lateral side surface wherein the lateral side edges are adapted to moveably engage the cutouts; and a rear plate comprising a lower part and lateral side edges, each of the lateral side edges comprising a curved support surface and a lateral side surface wherein the lateral side edges are adapted to moveably engage the cutouts;

the curved support surfaces of one of the front and rear plates being configured to engage the bottom surfaces of the cutouts;

the lateral side surfaces of one of the front and rear plates being configured to engage the lateral surfaces of the cutouts;

wherein each support surface of one of the front and rear plates is progressively distanced from each corresponding bottom surface such that the support surfaces and the cooperating bottom surfaces progressively enter into contact with one another when the beam bends.

22. A ski assembly comprising:

an elongated beam extending in a longitudinal direction, the beam including a sole, an upper surface and lateral sides, each lateral side including a cutout comprising a curved bottom surface located below the upper surface and a lateral surface;

a raised rigid platform disposed adjacent the upper surface in an area of a longitudinal central part of the beam, the platform including an upper part adapted to retain boot retaining elements and defining mounting zones, the platform comprising:

a front plate comprising a lower part and lateral side edges, each of the lateral side edges comprising a support surface and a lateral side surface wherein the lateral side edges are adapted to moveably engage the cutouts; and a rear plate comprising a lower part and lateral side edges, each of the lateral side edges comprising a support surface and a lateral side surface wherein the lateral side edges are adapted to moveably engage the cutouts;

the support surfaces of one of the front and rear plates being configured to engage the curved bottom surfaces of the cutouts;

the lateral side surfaces of one of the front and rear plates being configured to engage the lateral surfaces of the cutouts;

wherein each support surface of one of the front and rear plates is progressively distanced from each corresponding bottom surface such that the support surfaces and the cooperating bottom surfaces progressively enter into contact with one another when the beam bends.

23. A ski assembly comprising:

an elongated beam extending in a longitudinal direction, the beam including a bottom surface, an upper surface and lateral sides, each lateral side including a cutout comprising a bottom surface located below the upper surface and a lateral surface;

a raised rigid platform disposed adjacent the upper surface in an area of a longitudinal central part of the beam, the platform including an upper part adapted to retain boot retaining elements and defining mounting zones, the platform comprising:

a front plate comprising a lower part and lateral side edges, each of the lateral side edges comprising a support surface and a lateral side surface wherein the lateral side edges are adapted to moveably engage the cutouts; and a rear plate comprising a lower part and lateral side edges, each of the lateral side edges comprising a support surface and a lateral side surface wherein the lateral side edges are adapted to moveably engage the cutouts;

the support surfaces of one of the front and rear plates being configured to engage the bottom surfaces of the cutouts;

the lateral side surfaces of one of the front and rear plates being configured to engage the lateral surfaces of the cutouts; and a median block affixed to the beam, whereby each of the front and rear plates are connected the median block via a transverse axis, wherein each support surface of one of the front and rear plates is progressively distanced from each corresponding bottom surface such that the support surfaces and the cooperating bottom surfaces progressively enter into contact with one another when the beam bends.

* * * * *